United States Patent [19]

Barker

[11] Patent Number: 4,516,689

[45] Date of Patent: May 14, 1985

[54] EASY OPEN/RECLOSABLE CONTAINER WITH POURING LIP AND HOLD-OPEN FEATURE

[75] Inventor: Dale E. Barker, Hamilton, Ohio

[73] Assignee: The Procter & Gamble Company, Cincinnati, Ohio

[21] Appl. No.: 623,792

[22] Filed: Jun. 22, 1984

[51] Int. Cl.[3] ..... B65D 51/22

[52] U.S. Cl. ..... 220/335; 220/259; 220/269; 220/90.4; 220/85 SP

[58] Field of Search ..... 220/335, 259, 269, 307, 220/339, 90.4, 85 SP, DIG. 5

[56] References Cited

U.S. PATENT DOCUMENTS

| | | | |
|---|---|---|---|
| Re. 21,310 | 12/1939 | Mackey | 221/11 |
| 2,098,763 | 11/1937 | Sebell | 221/11 |
| 2,661,861 | 12/1953 | Oldenburg | 220/31 |
| 2,974,824 | 3/1961 | Mansho | 220/53 |
| 3,217,951 | 11/1965 | Paal | 222/528 |
| 3,281,024 | 10/1966 | Henchert et al. | 222/484 |
| 3,300,106 | 1/1967 | Chmela | 222/517 |
| 3,302,818 | 2/1967 | Balocca et al. | 220/53 |
| 3,323,671 | 6/1967 | Minarik, Jr. et al. | 215/40 |
| 3,419,198 | 12/1968 | Pettersen | 222/541 |
| 3,424,338 | 1/1969 | Kazel | 220/54 |
| 3,441,167 | 4/1969 | Balocca | 220/53 |
| 3,980,213 | 9/1976 | Ramsay | 220/85 SP X |
| 4,054,205 | 10/1977 | Blow, Jr. et al. | 220/85 SP X |
| 4,243,156 | 1/1981 | Lobbestael | 220/90.4 X |
| 4,407,424 | 10/1983 | Heyn | 220/269 |
| 4,473,168 | 9/1984 | Cox | 220/259 X |
| 4,480,763 | 11/1984 | Schneider | 220/269 |

*Primary Examiner*—Steven M. Pollard

*Attorney, Agent, or Firm*—John J. Ryberg; E. Kelly Linman; John V. Gorman

[57] ABSTRACT

A container having an upstanding rim running around the periphery of its top lid and a pre-cut dispensing aperture therein is provided with an integral pouring lip/drain surface between the container's rim and dispensing aperture. The container is also provided with an easy-open/reclosing element that is hingedly attached to the container's top lid. The hinge, which is commonly referred to as an "over-center hinge", keeps the easy-open/reclosing element in a locked-open position while the container's contents are dispensed. The easy-open/reclosing element has a depending plug that is shaped complementary to the dispensing aperture. When pressed into the aperture, the plug initially seals the container and, if desired, can be used to reclose the container. In a particularly preferred embodiment, the easy-open/reclosing element is provided with a U-shaped flange that is shaped complementary to both the top lid's pouring lip and upstanding rim. When the easy-open/reclosing element is in its closed position, this U-shaped flange receives the container's pouring lip and rim and thereby protects them from dirt and dust contamination. This sanitary feature is particularly appealing if a consumer drinks the beverage directly from the container.

11 Claims, 6 Drawing Figures

EASY OPEN/RECLOSABLE CONTAINER WITH POURING LIP AND HOLD-OPEN FEATURE

TECHNICAL FIELD

The present invention pertains to easy-open/reclosable containers, and more particularly to an easy-open/-reclosable rimmed container having a hinged closure element with a hold-open feature and a pouring lip/-drain surface that is integrally formed within the container's top lid between a pre-cut dispensing aperture and the container's upstanding rim.

BACKGROUND OF THE INVENTION

Easy-open containers are widely used today in the packaging industry, particularly the beverage industrey. Typically, there containers are opened by either removing a pull tab that has been scored in the container's lid or by removing a pressure sensitive adhesive tape that covers a pre-cut dispensing aperture. An example of the latter type of opening means is disclosed in U.S. Pat. No. 3,389,827. These types of easy-open containers are generally acceptable to consumers if the container's contents are entirely consumed or dispensed at the same time. However, if the user desires to only partially consume the contents and store the remainder, these containers are objectionable because they cannot be reclosed to keep the contents fresh or to keep foreign matter such as dust and dirt from entering the opened container. Furthermore, if the beverage contains suspended solids such as fruit pulp, the container cannot be reclosed and shaken to redistribute such solids.

Recently, there have been several attempts to provide an easy-open container with reclosing means. One such attempt is generally shown in U.S. Pat. Nos. 4,164,303, which issued to Waterbury. Waterbury discloses several embodiments of an articulated closure element that is attached to a container having an upstanding rim about the periphery of the container's top lid. The closure element is hingedly mounted on the container's top lid adjacent to a pre-cut dispensing aperture and has a depending plug or bead on its undersurface that is shaped complementary to the aperture. After initial opening, the container can be reclosed by returning the closure element to its original position such that the depending plug or bead tightly engages the dispensing aperture.

Although Waterbury's articulated closure element does allow a rimmed container to be reclosed after initial opening, consumers nevertheless find this general type of container to be objectionable for the following reasons. First, when such a container is returned to its upright position after a portion of the beverage has been dispensed, a residual amount of beverage is inevitably trapped between the dispensing aperture and the container's upstanding rim. Thereafter, this residual tends to spread out over the container's lid and, during storage, starts to collect dirt and dust. Furthermore, if the beverage is sweet such as fruit juice, the residual attracts insects. Second, the closure element does not prevent dirt and dust from contaminating the container's lid and rim in the area where a consumer's lips come into contact if the consumer drinks directly from the container. Third, the friction fit between the closure's depending plug or bead and the aperture, which is the means for holding the closure element in its closed position, does not adequately prevent the closure element from popping out if the container is accidentally knocked over onto its side. Finally, Waterbury's means for holding the closure element in its open position is rather complicated and renders the container too expensive to manufacture.

In light of the above, it is a principal object of the present invention to provide a rimmed beverage container with an easy-open feature that can be used to reclose the container for subsequent storage of any remaining beverage and, if applicable, will allow the container to be shaken in order to redistribute solids such as fruit pulp.

Another principal object of the present invention is to provide a container with a hinged closure element that will remain in a locked-open position while the container's contents are being dispensed.

Another principal object of the present invention is to provide a rimmed beverage container with a pouring lip/drain surface that channels the container's contents up and over the container's rim when the container is tipped for dispensing purposes, and also channels any residual product remaining on the pouring lip/drain surface back into the container via the dispensing aperture when the container is returned to its upright position.

A further object of the present invention is to provide a rimmed container with a closure element that not only tightly closes the container's dispensing aperture, but also protects the container's lip-contacting surfaces, i.e. those surfaces that come into contact with a consumer's lips if the consumer drinks directly from the container, from dirt and other contaminants.

Another object of the present invention is to tightly secure a closure element in its reclosed position so that it will not readily pop out of the dispensing aperture and allow product to escape if the container is accidentally tipped over onto its side or gently shaken to redistribute solid particles such as fruit pulp.

SUMMARY OF THE INVENTION

As used in the following summary and detailed description of the present invention, the term "initial seal" or variations thereof is intended to mean an air-tight, hermetic seal. When the term "seal" or "reseal" is used in describing the container after the initial opening thereof, it is intended to mean a liquid leak-resistant seal rather than an air-tight, hermetic seal. In addition, the following summary and detailed description are generally directed to a beverage container. However, it will be readily apparent to those skilled in the art that the present invention can be practiced with equal facility in packaging a wide variety of liquids, for example soaps, chemicals, motor oils, and the like.

In a particularly preferred embodiment of the present invention, a beverage container having an upstanding rim running around the periphery of its top lid and a pre-cut dispensing aperture in the lid is provided with an integral pouring lip/drain surface between the rim and the dispensing aperture. When the container is tipped for dispensing purposes, the integral pouring lip/drain surface channels the product up and over the upstanding rim. When the container is returned to its upright position, the pouring lip/drain surface channels any residual product remaining between the aperture and rim back into the container rather than allowing it to spread out over the lid.

In this particularly preferred embodiment, the container is also provided with an easy-open/reclosing element that is hingedly attached to the lid's outer surface. The closure element's hinge, which is commonly referred to as an over-center hinge, is a simple and inexpensive means for holding the closure element in a locked-open position while the container's contents are being dispensed. The easy-open/reclosing element also has a depending plug on its bottom surface that is shaped complementary to the dispensing aperture. This depending plug is used to seal the container's dispensing aperture before initial opening and, when returned to its original position, after a portion of the container's contents have been dispensed.

In this particularly preferred embodiment, the easy-open/reclosing element is also provided with an integral U-shaped flange that is chaped complementary to the container's upstanding rim and pouring lip. This U-shaped flange gives the container two attractive features. First, when the reclosing element is in its closed position, the U-shaped flange receives the container's rim and pouring lip and protects them against dust and dirt contamination. This feature is particularly appealing if the consumer desires to drink the beverage directly from the container. Second, the friction fit between the reclosing element's U-shaped flange and the container's rim helps keep the reclosing element secured in its reclosed position during storage.

In the particularly preferred embodiment, the easy-open/reclosing element is further provided with a grasping tab that facilitates easy opening by the consumer. The grasping tab is attached to the easy-open/reclosing element along a frangible line that breaks when the grasping tab is lifted from the container's top lid to initially open the container.

In another preferred embodiment, a beverage container having an upstanding rim running around the periphery of its top lid and a pre-cut dispensing aperture in the lid is provided with an attachable closure/pouring lip device. The container's pre-cut dispensing aperture is initially sealed with, for example, a thermosealed tape. Once the tape is removed, the device is snapped in place on the container's top lid for dispensing and reclosing purposes.

The attachable closure/pouring lip device consists of a base portion having a pre-cut aperture that is shaped complementary to the pre-cut aperture in the container's lid. The base portion's bottom surface has a small bead that encircles the aperture therein. When the closure/pouring device is attached to the container's top lid, this bead sealingly snap fits into the lid aperture and holds the closure/pouring device in place. The base portion also has a U-shaped flange at one end that is shaped complementary to the container's upstanding rim. When the reclosing/pouring device is properly placed on the container's lid, the friction fit between the container's rim and the U-shaped flange further helps in securing the device to the top lid.

The attachable closure/pouring device also has a pouring lip/drain surface between the base portion's dispensing aperture and U-shaped flange. When the container is tipped for dispensing purposes after the device has been properly secured on the container's top lid, this pouring lip/drain surface channels the container's contents up and over the container's rim. Similarly, when the container is returned to its upright position, the pouring lip/drain surface channels any residual product remaining on the pouring lip/drain surface back into the container.

The attachable closure/pouring lip device is further provided with a closure element that is hingedly attached to the base portion. The hinge, which is commonly referred to as an over-center hinge, is a simple and inexpensive means for holding the closure element in a locked-open position while the container's contents are being dispensed. This closure element also has a depending plug on its bottom surface that is shaped complementary to both the aperture in the base portion and the aperture in the container's lid. When it is desired to reclose the container, the closure element is pushed down such that the depending plug snugly enters the aperture in the device's base portion and the aperture in the container's lid.

In a particularly preferred embodiment of the reclosing/pouring lip device, the closure element is further provided with a U-shaped flange that is shaped complementary to both the base portion's U-shaped flange and pouring lip/drain surface. When the closure element is pressed down into its closed position, the base portion's U-shaped flange is received by the closure element's U-shaped flange in a friction fit arrangement and thereby contributes in keeping the closure element in its closed position. The closure element's U-shaped flange also serves the important function of protecting the base portion's U-shaped flange and pouring lip area against dirt, dust, and other contaminant accumulation.

BRIEF DESCRIPTION OF THE DRAWINGS

While the specification concludes with claims that particularly point out and distinctly claim the present invention, it is believed that the present invention will be better understood by reading the following description with references made to the following drawings in which:

DETAILED DESCRIPTION OF THE INVENTION

Figure 1:
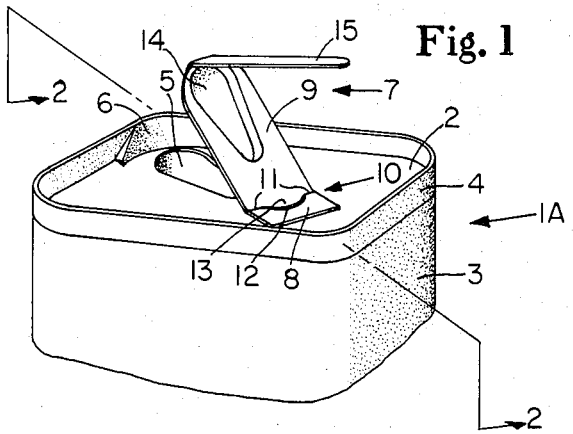
FIG. 1 is a perspective view of the top portion of a preferred container shown with the closure element in its partially opened position.

FIG. 1 shows the top portion of a rimmed beverage container, generally denoted as 1A, after it has been partially opened. In FIG. 1, top lid 2 is attached to container body portion 3 by any of several operations known to those skilled in the art of container manufacturing. Illustrative of such operations are single seaming and double seaming. Alternatively, top lid 2 and body portion 3 can be integrally formed together as would be the case if the container was molded from a thermoplastic material. Regardless of the type of manufacturing operation used, the container of the present invention has an upstanding rim 4 running around the periphery of top lid 2. Body portion 3 can be made from a wide variety of materials that are suitable for a beverage container such as aluminum, fiberboard, plastic, or a combination thereof. Similarly, top lid 2 can also be made from a wide variety of materials such as thermoformed PVC, aluminum, or a laminate comprised of PVC, aluminum foil, and polyethylene.

As seen in FIG. 1, top lid 2 has a pre-cut dispensing aperture 5 that is generally located between the center of the lid and upstanding rim 4. The aperture shown in FIG. 1 is tear-shaped but may take on other shapes such as oval or circular. Integrally formed within top lid 2 between dispensing aperture 5 and upstanding rim 4 is a pouring lip/drain surface 6. When the user of the present invention tips the container to dispense a portion of the container's contents into, for example, a cup or glass, pouring lip 6 channels the beverage up and over the container's upstanding rim 4 rather than allowing a portion of the beverage to be trapped between rim 4 and aperture 5. When the container is thereafter returned to its upright position, any residual product remaining on pouring lip/drain surface 6 is channeled back inside the container via dispensing aperture 5 rather than spreading out over the surface of top lid 2, as would be the undesirable situation if pouring lip/drain surface 6 were not present.

Still referring to FIG. 1, a closure element generally denoted as 7 is provided as the means for both initially sealing the container and subsequently reclosing the container after it has been initially opened. A particularly suitable material for making closure element 7 is thermoformed K-Resin ®, which is available from the Phillips Chemical Company of Pasadena, Tex. Also suitable is a multilayer film comprised of polystyrene, PVDC, and polyethylene, which is available from Continental Can Company, Stamford, Conn., and designated as Cobelplast A.95. Closure element 7 comprises a fixed portion 8 and a movable portion 9 with a hinge, generally denoted as 10, separating the two. Fixed portion 8 is securely attached to top lid 2 adjacent to dispensing aperture 5 which, depending on the materials used, can be accomplished by a heatsealing, adhesive bonding or solvent bonding process. As used in the art, "hotsealing" means applying heat and pressure to two separate pieces that are coated with a low melt polymer; adhesive bonding means using a heated glue or adhesive, which is typically a polymer sudh as EVA or LDPE with a wax additive; "solvent bonding" typically involves the surface "melting" of two polymeric pieces by applying a solvent followed by heat which drives off the solvent and leaves the two pieces fused together.

Figure 2:
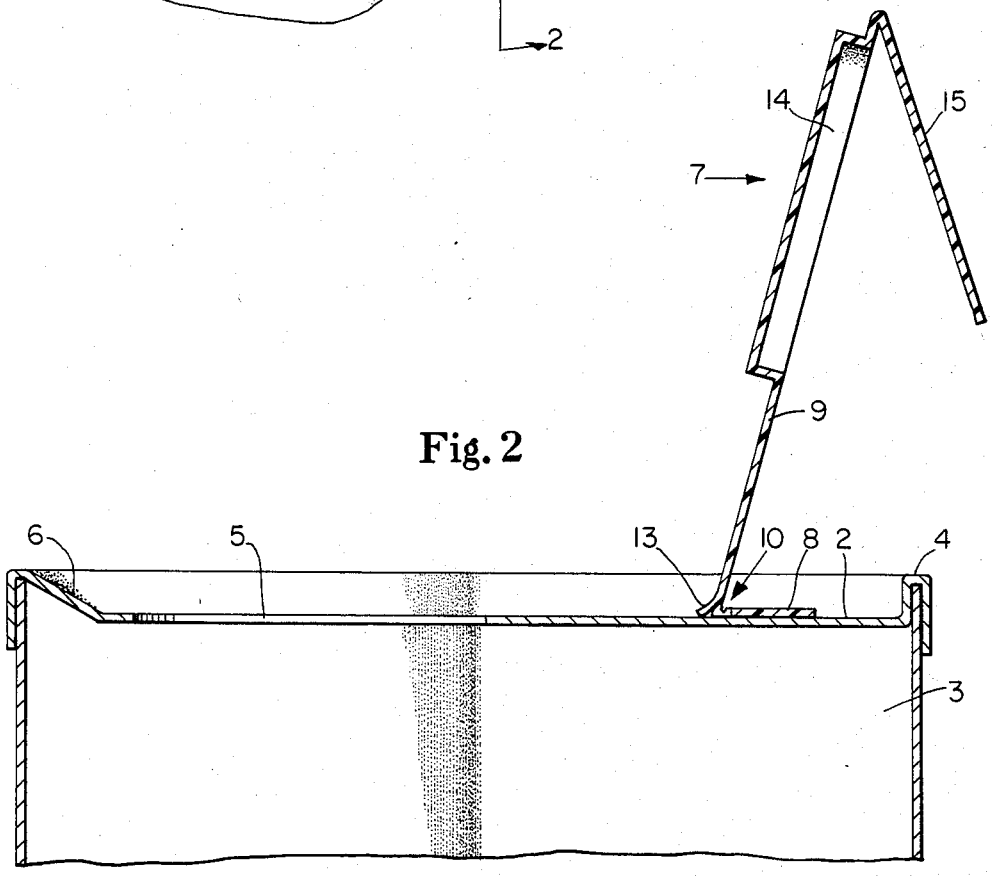
FIG. 2 is an enlarged cross-sectional view of the container shown in FIG. 1 taken at a point corresponding to section line 2—2, but shown with the closure element in its locked-open position.

As shown in FIG. 1, hinge 10 consists of two fold lines 11, a crescent-shaped cut or slit 12, and a semi-circular area 13 on the lower edge of movable portion 9. This unique configuration, which is commonly referred to as an "over-center hinge", is a simple and inexpensive means for holding closure element 7 in a locked-open position, as seen in FIG. 2. In operation, the over-center hinge works as follows: when movable portion 9 of closure element 7 is gradually lifted up and away from dispensing aperture 5, the semi-circular area 13 of movable position 9 begins to bend against top lid 2 but remains adjacent to fixed portion 8, as seen in FIG. 1. Then, when movable portion 9 is brought back past its over-center position, i.e., beyond perpendicular from top lid 2, semi-circular area 13 snaps through crescent-shaped cut 12 to a point remote from fixed portion 8. Finally, when movable portion is released, semi-circular area 13 bends backwards against top lid 2 and holds movable portion 9 in a locked-open position, as seen in FIG. 2. Container 1A can then be tipped to dispense the product therein without movable portion 9 flopping back down over dispensing aperture 5, thereby eliminating the need to manually hold movable partition out of the way of the fluid flow.

Still referring to FIGS. 1 and 2, movable portion 9 of closure element 7 has a depressed plug portion 14 that is shaped complementary to dispensing aperture 5. Preferably, plug 14 is just slightly larger in size than aperture 5 so that there is a tight friction fit between the two when movable portion 9 is in its closed position. This tight friction fit provides a seal sufficient to allow a consumer to shake the container to redistribute solids such as fruit pulp. In a preferred embodiment, a grasping tab 15 is hingedly attached to movable portion 9 to facilitate easy grasping of movable portion 9 by the user.

Figure 3:
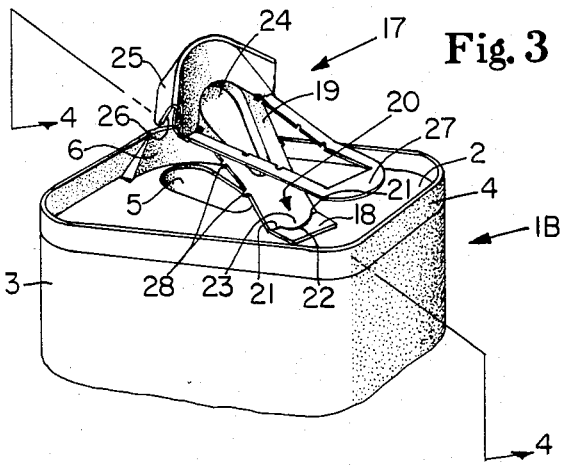
FIG. 3 is a perspective view of the top portion of another preferred container shown with the closure element in its partially opened position.
Figure 4:
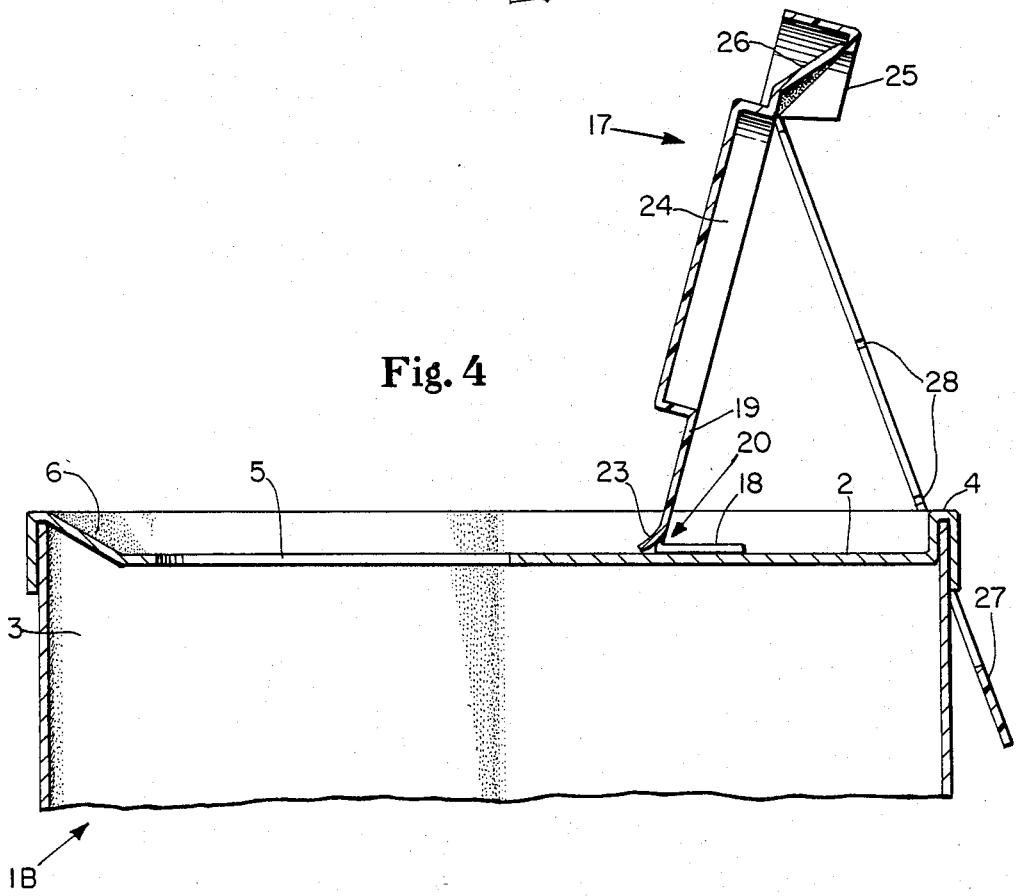
FIG. 4 is an enlarged cross-sectional view of the container shown in FIG. 3 taken at a point corresponding to section line 4—4, but shown with the closure element in its locked-open position.

FIGS. 3 and 4 illustrate a particularly preferred embodiment of the present invention that is similar to the one shown in FIGS. 1 and 2, but with the addition of several attractive features. In FIG. 3, the container generally indicated as 1B has a top lid 2, a container body portion 3, an upstanding peripheral rim 4, a pre-cut dispensing aperture 5, and a pouring lip/drain surface 6 that is integrally formed within top lid 2 between aperture 5 and upstanding rim 4. Pouring lip/drain surface 6 again serves the important function of channeling product up and over rim 4 when the container is tipped for dispensing purposes and channeling product back into the container when the container is returned to its upright position.

As seen in FIG. 3, a closure element generally indicated as 17 is hingedly attached to top lid 2 adjacent to dispensing aperture 5. Closure element 17 has a fixed portion 18, a movable portion 19, and a hinge generally indicated as 20 separating the two. Hinge 20 is an over-center hinge that has two fold lines 21, a crescent shape slit 22, and a semi-circular area 23. Over-center hinge 10 operates in the same manner as the hinge shown in FIGS. 1 and 2 and provides the means for locking movable portion 19 in a fully-opened position, as shown in FIG. 4.

Still referring to FIGS. 3 and 4, a depending plug 24, which is shaped complementary to aperture 5, is located on the underside of movable portion 19. When closure element 17 in its closed position, depending plug 24 enters aperture 5 and seals the container thereby allowing a consumer to shake the container if desired. Movable portion 19 also has a U-shaped flange 25 at its outermost area. The inner surface 26 of U-shaped flange 25 is shaped complementary to upstanding rim 4 and pouring lip/drain surface 6. When closure element 17 is in its closed position, U-shaped flange 25 receives both upstanding rim 4 and pouring lip 6. This attractive feature protects rim 4 and lip 6 from dirt and dust contamination during storage and is particularly attractive if a consumer desires to drink directly from the container. Movable portion 19 is also provided with a grasping tab 27 that is frangibly attached to closure element 17 by a series of frangible links 28. Before the container is opened, grasping tab 27 initially lays flat on the surface of top lid 2. When tab 27 is lifted up from the surface of top lid 2, the tab separates, i.e. breaks free from closure element 17 along frangible links 28, as shown in FIGS. 3 and 4, thereby providing a convenient means for a consumer to grasp closure element 17 and open the container.

Figure 5:
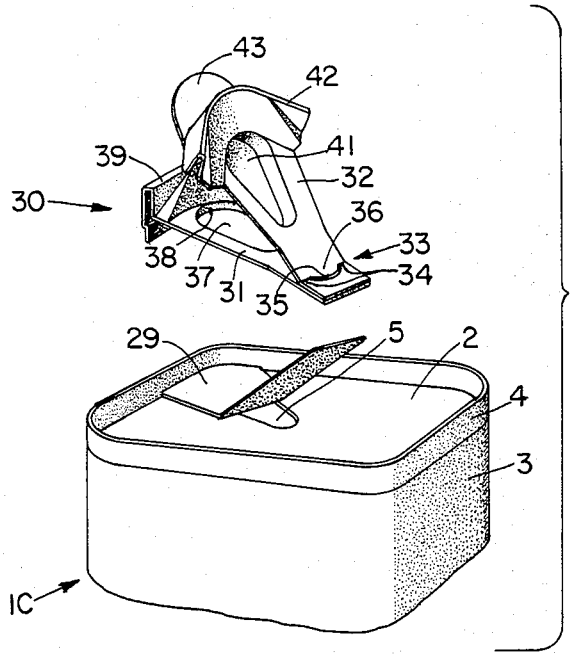
FIG. 5 is a perspective view of the top portion of a container and an attachable closure/pouring lip device of the present invention.
Figure 6:
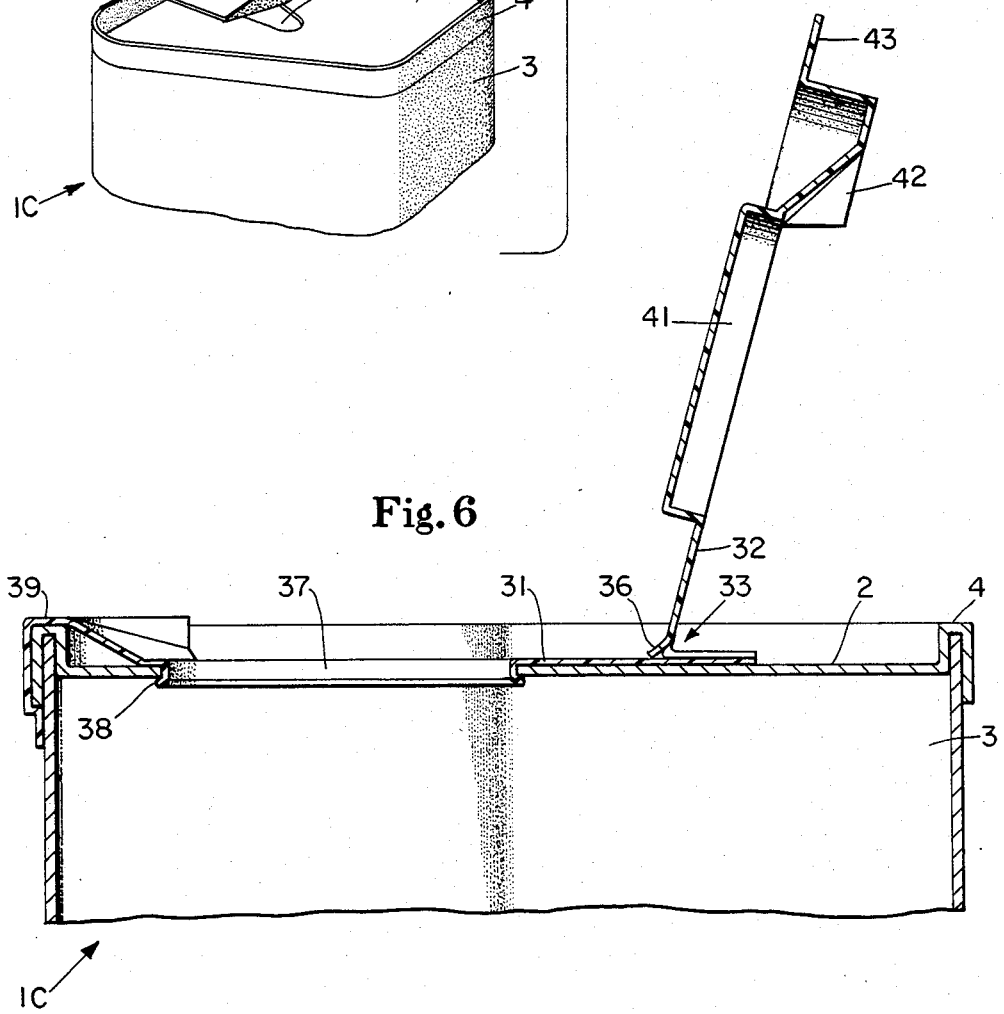
FIG. 6 is an enlarged cross-sectional view of the container shown in FIG. 5 viewed from the same angle as FIGS. 2 and 4 with the closure/pouring lip device attached to the container's top lid and shown in its locked-open position.

FIGS. 5 and 6 show an alternative embodiment of the present invention in the form of a pouring/reclosing device that is attachable to a container's top lid after the container has been initially opened. FIG. 5 shows the top portion of a container generally denoted as 1C that has a top lid 2, a body portion 3, and an upstanding rim 4. Top lid 2 has a pre-cut dispensing aperture 5 that is initially sealed with, for example, a fully removably adhesive tape tab 29 (shown in the process of being removed by a consumer). An example of such a tape tab is shown in U.S. Pat. No. 3,312,368, which is hereby incorporated by reference. A pouring/reclosure device generally denoted as 30 is shown just before it is attached to the top lid 2 of container 1C. Pouring/reclosure device 30 can either be sold separate from the container or can be included with the container and loosely attached thereto by, for example, putting the container and device 30 within a heat-shrinkable plastic wrapper.

Pouring/reclosing device 30 generally comprises a base portion 31 and a movable portion 32 that is attached to base portion 31 by a hinge, which is generally denoted as 33. Hinge 33, which is commonly referred to as an over-center hinge, comprises fold lines 34, a crescent-shaped cut 35, and semi-circular area 36. Over-center hinge 33 operates in the same manner as described earlier and provides the means for holding movable portion 32 in a locked-open position when movable portion 31 is brought back past perpendicular from top lid 2, as shown in FIG. 6.

Still referring to FIG. 5, base portion 31 has a dispensing aperture 37 that is shaped complementary to dispensing aperture 5 in the container's top lid 2. A bead 38 is located on the undersurface of base portion 31 and runs around the periphery of dispensing aperture 32. When pouring/reclosing device 30 is properly attached to top lid 2 as shown in FIG. 6, bead 38 snugly snaps into dispensing aperture 5 and firmly holds base portion 31 in place. Base portion 31 also has a downwardly projecting U-shaped flange 39 that is shaped complementary to the container's upstanding rim 4. When pouring/reclosing device 30 is properly attached to lid 2 as seen in FIG. 6, U-shaped flange 39 snugly receives rim 4 and helps in firmly securing base portion 31 to top lid 2.

Also shown in FIGS. 5 and 6 is a pouring lip/drain surface 40 that is integrally formed in base portion 31 between dispensing aperture 37 and U-shaped flange 39. When pouring/reclosing device 30 is attached to top lid 2 and container 1C is tipped to dispense the product therein, pouring lip 40 channels the product up and over U-shaped flange 39. Similarly, when container 1C is returned to its upright position, pouring lip 40 channels any residual product remaining thereon back into container 1C via dispensing apertures 37 and 5 rather than allowing the residual product to spread out over top lid 2.

As briefly described earlier, pouring/reclosing device 30 has a movable portion 32 that is attached to base portion 31 by means of an over-center hinge 33. Movable portion 32 has a depending plug 41 that is shaped complementary to both dispensing apertures 5 (in top lid 2) and 37 (in base portion 31). After container 1C has been initially opened and pouring/reclosing device 30 has been properly attached to top lid 2, the container can be reclosed by bringing movable portion 32 down into contact with base portion 31 such that depending plug 41 sealingly enters both apertures 5 and 37.

In the preferred embodiment shown in FIG. 5, movable portion 32 has a U-shaped flange 42 that is shaped complementary to U-shaped flange 39 and pouring lip/drain surface 40 of base portion 31. When movable portion 32 is in its closed position, U-shaped flange 42 snugly receives U-shaped flange 39 and pouring lip 40 and keeps these critical areas protected against dirt and other contaminants. In addition, the friction fit between complementary U-shaped flanges 39 and 42 helps in securing movable portion 32 in its closed position. Movable portion 32 can also be provided with a flexible grasping tab 43 to facilitate easy-opening by a consumer.

While several particularly preferred embodiments of the present invention have been described and illustrated, it is obvious to those skilled in the art that various changes and modifications can be made without departing from the spirit and scope of the invention. Furthermore, while the preceding description of the present invention was generally directed to a beverage container, the present invention can be applied with equal facility to any container that is used to package a liquid product. Accordingly, the following claims are intended to embrace such changes, modifications, and applications that are within the scope of this invention.

What is claimed is:

1. An easy-open, reclosable container comprising:

(a) a hollow body portion having an uppermost and lowermost edge, said lowermost edge having a bottom end panel attached thereto;

(b) a top lid attached to said uppermost edge of said body portion, said top lid having a discrete dispensing aperture therein and an upwardly-projecting, peripheral rim;

(c) a pouring lip integrally formed within said top lid between said dispensing aperture and said peripheral rim;

(d) a closure element having a movable portion, a fixed portion, and an over-center hinge, said movable portion having a downwardly-projecting plug that is shaped complementary to said dispensing aperture whereby said aperture will readily receive said plug, said fixed portion being attached to said top lid adjacent to said dispensing aperture; and (e) means for releasably securing said plug within said dispensing aperture.

2. The container as recited in claim 1 wherein said means for releasably securing said plug within said dispensing aperture comprises a friction fit between said plug and said dispensing aperture.

3. The container as recited in claim 1 wherein said movable portion of said closure element has a grasping tab attached thereto.

4. The container as recited in claim 3 wherein said movable portion of said closure element has a downwardly-projecting U-shaped flange that is shaped complementary to said upwardly-projecting peripheral rim and said pouring lip whereby said U-shaped flange receives said rim and said pouring lip when said movable portion is in its closed position.

5. The container as recited in claim 4 wherein said means for releasably securing said plug within said dispensing aperture comprises a friction fit between said downwardly-projecting U-shaped flange and said upwardly-projecting peripheral rim.

6. The container as recited in claim 4 wherein said U-shaped flange has a grasping tab attached thereto.

7. A dispensing/reclosing device for use on a container, said container having a peripheral rim projecting upwardly from the top lid of said container, said top lid having a fast dispensing aperture therein, said device comprising:

(a) a base portion having a top and bottom surface and a second dispensing aperture that corresponds both in size and shape to said first dispensing aperture, said base portion further having a first U-shaped flange that is shaped complementary to said upwardly-projecting peripheral rim whereby said first U-shaped flange will readily receive said rim when said device is applied to said top lid of said container;

(b) a pouring lip integrally formed within said base portion between said second aperture and said first U-shaped flange;

(c) a closure element having a downwardly-projecting plug that is shaped complementary to both first and second dispensing apertures whereby said apertures will readily receive said plug when said device is attached to said top lid of said container and said closure element is in its closed position, said closure element being attached to said top surface of said base portion by an over-center hinge;

(d) means for releasably securing said plug within said first and second dispensing apertures; and (e) means for securing said device to the top lid of said container whereby said second aperture of said base portion coincides with said first dispensing aperture of said top lid.

8. The dispensing/reclosing device as recited in claim 7 wherein said means for releasably securing said plug within said first and second dispensing apertures comprises a friction fit between said plug and said first and second apertures.

9. The dispensing/reclosing device as recited in claim 7 wherein said means for securing said device to the top lid of said container comprises a friction fit between said first U-shaped flange of said base portion and said upwardly-projecting peripheral rim.

10. The dispensing/reclosing device as recited in claim 7 wherein said bottom surface of said base portion has a small bead that encircles said second dispensing aperture whereby said bead enters and tightly engages said first dispensing aperture in said top lid when said device is applied to said top lid.

11. The dispensing/reclosing device as recited in claim 7 wherein said closure element has a second U-shaped flange that is shaped complementary to said first U-shaped flange and said pouring lip of said base portion whereby said second U-shaped flange will readily receive said first U-shaped flange and said pouring lip when said device is attached to said top lid of said container and said closure element is in its closed position.

* * * * *

UNITED STATES PATENT AND TRADEMARK OFFICE

CERTIFICATE OF CORRECTION

PATENT NO. : 4,516,689

DATED : May 14, 1985

INVENTOR(S) : Dale E. Barker

It is certified that error appears in the above-identified patent and that said Letters Patent is hereby corrected as shown below:

Column 1, line 17,"trey" should read -- try --.

Column 1, line 35, "Nos." should read -- No. --.

Column 3, line 13, "this" should read -- the --.

Column 3, line 15, "chaped" should read -- shaped --.

Column 5, line 52, "sudh" should read -- such --.

Signed and Sealed this

*Twelfth* Day of *November 1985*

[SEAL]

*Attest:*

DONALD J. QUIGG

*Attesting Officer*

*Commissioner of Patents and Trademarks*